United States Patent [19]

Boucquey et al.

[11] 4,185,428

[45] Jan. 29, 1980

[54] JOINT FOR SEALING LOGS OF LOG TYPE BUILDING STRUCTURES

[76] Inventors: Jacques Boucquey, 13 St. Laurent St., West, Longueuil, Canada; Bernard Laporte, 3312 Clément St., Fabreville, Canada; Serge Lavallee, 9 du Grand Ravin Ave., St. Julie, Canada, J0L 2C0

[21] Appl. No.: 895,926

[22] Filed: Apr. 13, 1978

[51] Int. Cl.[2] ..... E04B 1/10

[52] U.S. Cl. ..... 52/233

[58] Field of Search ..... 52/233, 346, 395, 394

[56] References Cited

U.S. PATENT DOCUMENTS

| | | | |
|---|---|---|---|
| 1,863,231 | 6/1932 | Thune | 52/394 |
| 1,953,460 | 4/1934 | Bernhard | 52/233 |
| 1,996,735 | 4/1935 | King | 52/233 |
| 3,460,301 | 4/1969 | Davis | 52/233 |
| 3,557,503 | 1/1971 | Snyder | 52/403 |

FOREIGN PATENT DOCUMENTS

| | | | |
|---|---|---|---|
| 2309878 | 8/1974 | Fed. Rep. of Germany | 52/233 |
| 2328819 | 3/1975 | Fed. Rep. of Germany | 52/396 |

*Primary Examiner*—James A. Leppink
*Assistant Examiner*—H. E. Raduazo

[57] ABSTRACT

A joint for sealing juxtaposed parallel logs separated by spacers, which are narrower than the width of the log, is disclosed. The joint comprises a flat strip of resilient material having profiled flanges bent at about right angles with respect to the flat portion of the strip and adapted to be snapped in confronting longitudinal grooves made in the juxtaposed logs, and an insulating sealing material interposed between the strip and the spacer.

3 Claims, 3 Drawing Figures

JOINT FOR SEALING LOGS OF LOG TYPE BUILDING STRUCTURES

This invention relates to a joint for sealing juxtaposed logs arranged in parallel relation, and more particularly juxtaposed, square or rectangular logs separated by spacer blocks, as used in the fabrication of log type building structures.

PRIOR ART

In building structures made of juxtaposed logs, leaks often develop between the logs due to the twisting and shrinking of the logs as the wood dries out. Attempts have been made to overcome this problem by providing the juxtaposed logs with confronting longitudinal grooves and inserting a wooden strip in such grooves. Alternatively, one of the logs has been provided with a longitudinal tongue adapted to be inserted into a corresponding groove in the other log. However, as the logs dry out, twisting and shrinkage cause the wooden tongue to crack or break, resulting in leaks.

It has also been common practice to seal juxtaposed logs by grouting with cementeous material or by caulking. However, such joints also crack and develop leaks.

It has also been proposed in U.S. Pat. No. 3,460,301 to join superposed logs by means of a flexible metal, or plastic strip, provided with a deformable central portion and marginal edges adapted to engage confronting grooves in the juxtaposed logs. However, this joint must be installed during the construction of the building and cannot be added to an already built house or cabin. In addition, the installation is time-consuming and expensive.

BRIEF DESCRIPTION OF THE INVENTION

It is therefore the object of the present invention to provide a joint which is easy to install and, in addition, may be added to an already built home or cabin.

The joint in accordance with the invention, for sealing a wall made of juxtaposed parallel logs separated by spacer blocks of narrower width than the logs and spaced from one another within the space between two juxtaposed logs, comprises a flat strip of resilient material and profiled to form a flange extending at an angle with respect to the main flat portion of the strip and spaced from said logs, said strip having opposite terminal longitudinal edge portions adapted to be snapped in confronting longitudinal grooves made in the juxtaposed logs. Said flange is free to change its angle relative to said main portion upon variations in the spacing between said logs and said opposite terminal longitudinal edge portions are biased in respective engagement with said grooves.

The joint may be installed on the inside as well as the outside face of the log wall when its inside face is also exposed.

In the strip used for the inside exposed face of the log wall, the above flange is a top flange slidably fit into a groove of predetermined depth and width, and the strip also has a bottom flange which is inwardly directed and abuts the underlying log and is preferably provided with a V-shaped terminal edge portion which permits snapping of the profiled edge of the strip into the groove of the underlying log. Of course, an opposite arrangement could also be used and the shape of the flanges may vary provided that the strip may be snapped in position.

In a preferred embodiment of the main flat portion of the invention, the width of the strip, adapted to be mounted on an outside face of the log wall, is slightly greater than the thickness of the spacer and the bottom profiled edge of the strip is first bent back to form a portion extending upwardly along the main portion before being bent to form said first-named flange, so as to permit overlapping of the edge of the strip with the bottom log to prevent water from flowing between the two logs. The bottom log is peferably milled at the corner and the bottom of the strip bears against such milled portion.

SHORT DESCRIPTION OF THE DRAWINGS

The invention will now be disclosed, by way of example, with reference to the accompanying drawings, in which.

DESCRIPTION OF A PREFERRED EMBODIMENT OF THE INVENTION

Figure 1:
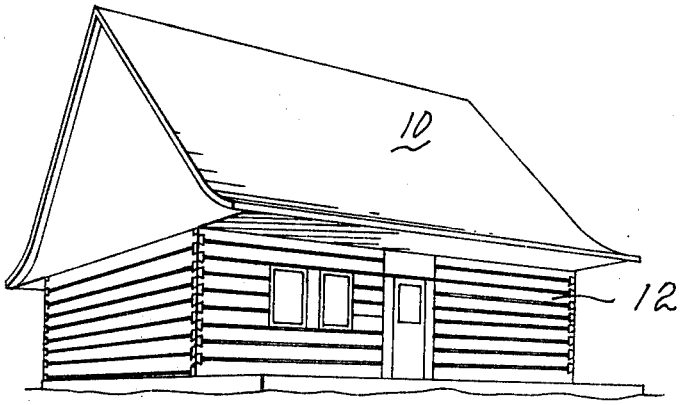
FIG. 1 illustrates a perspective view of a house made of logs joined by the joint in accordance with the invention.
Figure 2:
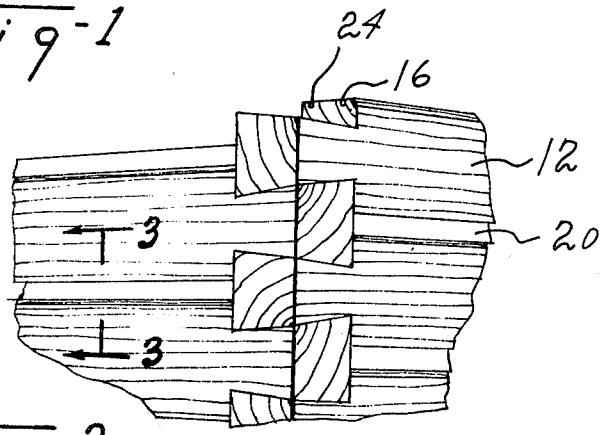
FIG. 2 illustrates an enlarged portion of a wall of the house showing the joint in accordance with the invention.
Figure 3:
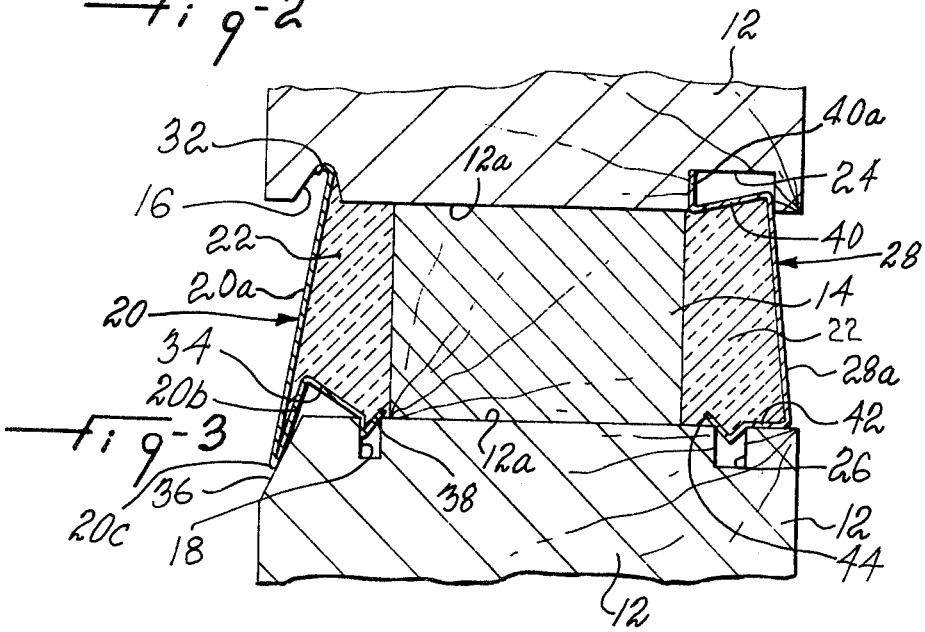
FIG. 3 illustrates a section view, taken along lines 3—3 of FIG. 2.

Referring to FIGS. 1–3, there is schematically shown a house 10, the walls of which are made of juxtaposed horizontal, self-supporting logs 12 separated by several spacer blocks 14 distant one from the other and engaging the confronting faces 12*a* of logs 12. Insulating material 22 fills the space between and around the blocks 14 and between the logs 12. Between the outside exposed face of the wall of the house and the blocks 14, the confronting face 12*a* of, the top log 12 is provided with a groove 16 and the confronting face 12*a* of the bottom log is provided with a groove 18. Grooves 16 and 18 run substantially parallel to the exposed outer face of the logs. A strip 20, of suitable length, is secured in position in grooves 16 and 20. On the inside exposed face of the log wall, the top log is provided with a groove 24 and the bottom log with a groove 26. Grooves 24 and 26 are made in confronting faces 12*a* and run substantially parallel to the inside face of the log wall between said inside face and blocks 14. A strip 28, of suitable length, is secured in position in grooves 24 and 26.

Both strips 20 and 28 are generally made of flexible material, such as aluminum, steel, reinforced fiberglass or high quality rubber. The aluminum and steel strips are preferably covered with granular pre-baked paint, whereas the reinforced fiberglass and rubber strips have integrated pigments of suitable color.

Both strips are profiled inwardly at an angle with respect to the flat main portion of the strip. Strip 20 has a main flat portion 20*a* bridging the space between the two logs and a top outwardly curved terminal free edge portion 32 directly engaging groove 16. The main portion 20*a* of strip 20 is slightly wider than the thickness of spacer blocks 14 and is bent back at its lower edge 20*c* to form a portion 20*b* extending upwardly along and inwardly of main portion 20*a* . The bottom log 12 is milled at the corner 36 and portion 20*b* of the strip 20 bears against such milled portion. However, bottom edge 20*c* of main portion 20*a* is free to move up and down relative to the bottom log 12. Portion 20*b* extends upwardly to a higher level than confronting face 20*a* of the bottom log 12 and a bottom flange 34 extends from the top edge of portion 20*b* inwardly and downwardly towards the spacer blocks 12 and toward the confronting face 12*a* of the bottom block 12. Flange 34 is provided with a V-shaped terminal edge 38, which engages groove 18 and bridges the same. Flange 34 is maintained spaced from the bottom log 12 and is thus allowed to vary its angle in accordance with variations in spacing between the top and bottom logs 12. The resiliency of flange 34, not only biases the upper longitudinal edge 32 and the lower longitudinal edge 38 in constant engagement with grooves 16 and 18, respectively, but also biases bent back portion 20*b* against milled portion 36 of the outer face of the bottom log 12. Strip 28 has a flat main portion 28*a* bridging the space between the two logs and has top flange 40 bent inwardly at substantially right angle and a bottom flange 42, also bent inwardly at about right angle. The top flange 40 is adapted to slidably fit in groove 24, but is maintained spaced from the bottom of said groove by upwardly extending free edge portion 40*a* which abuts against the bottom of the groove. Bottom flange 42 abuts against confronting face 12*a* of bottom log 12 and is provided with a V-shaped terminal edge 44 which engages groove 26. Flange 40 is maintained spaced from the bottom of the groove 24 and is thus allowed to vary its angle in accordance with the variations in spacing between the top and bottom logs 12.

It is to be understood that the shape of the grooves in the logs and also of the profiled flanges of the strips 20 and 28 may vary, depending on the size and shape of the logs and also on the desired appearance of the joint. The outside strip overlaps the bottom log to permit water from flowing between two logs. The inside strip has no overlap and is more or less vertical.

The afore-described joint is installed as follows:

After isulation 22 has been placed in position, the top flange 32 of strip 20 is placed in groove 16 and the bottom of the strip pushed inwardly. The V-shaped terminal edge 38 slides over the top of the bottom log and falls into slot 18. Similarly, the top of flange 40 of strip 28 is inserted into groove 24 and the bottom of the strip pushed inwardly. The V-shaped terminal edge 44 slides over the bottom log and falls into groove 26. It is seen that the above strips 20 and 28 can be easily installed by semi-skilled personnel in a very short time. Such strips 20 and 28 are generally made in 16' lengths so as to extend the full length of the wall.

Although the invention has been disclosed with reference to a preferred embodiment, it is to be understood that it is not to be limited to this embodiment but by the scope of the claims only. Indeed, the profiled flanges of the strips may vary in shape, the only requisite being that they may be snapped into place between two adjacent logs to seal the logs.

What we claim is:

1. A joint for sealing a pair of juxtaposed substantially parallel and horizontally disposed, upper and lower logs separated by spacer blocks located at spaced intervals along said logs and which are recessed from the exposed face of said logs, said logs having confronting faces engaged by said spacer blocks and provided with longitudinally extending grooves arranged substantially parallel to said exposed face and between said exposed face and said spacer blocks, said joint comprising a flat strip of resilient material having a profile including, from one longitudinal edge to the other longitudinal edge, a first terminal, longitudinal edge portion forming the top free edge of said strip and engaging the groove of the upper log, a main portion bridging the space between said logs and overlapping the exposed space of the lower log, said main portion being extended at its lower longitudinal edge by a bent back inner portion extending upwardly and inwardly of said main portion and having its upper longitudinal edge disposed above the level of the confronting face of said lower log, a flange extending from the upper longitudinal edge of said bent back portion and being downwardly inclined and directed towards said spacer blocks and towards the confronting face of said lower log, and a second terminal longitudinal edge portion formed at the outer free edge of said flange and engaging the groove of the lower log, said flange being spaced from said logs, so as to be free to change its angle relative to said main portion upon variations in the spacing between said logs, said first and said second terminal longitudinal edge portions being biased in respective engagement with the respective grooves of said logs, and said bent back portion being biased against the outer face of said lower log.

2. A joint as claimed in claim 1, wherein said second terminal longitudinal edge has a V-shaped cross-section engaging and bridging the groove at the confronting face of said lower log.

3. A joint for sealing a pair of horizontally disposed, parallel, self-supporting upper and lower logs forming part of an outer wall of a building and separated by spacer blocks disposed at spaced zones along said logs and which are narrower than the width of the logs and are recessed from the exposed outer face of the logs, said logs having confronting faces engaged by said spacer blocks and provided with longitudinally extending grooves arranged substantially parallel to said outer face and between said outer face and said spacer blocks, said joint comprising a strip of resilient material having a profile including, from one longitudinal free edge to the other longitudinal free edge, an upper longitudinal edge portion fitted within the groove of said upper log, a main portion bridging the space between said upper and lower logs and overlapping the outer face of said lower log, a bent back portion extending upwardly from the lower edge of said main portion and inwardly of the same, and having its upper longitudinal edge disposed above the level of the confronting face of said lower log, said bent back portion being in turn extended at its upper longitudinal edge by a downwardly inclined flange directed towards said spacer blocks and towards the confronting face of said lower log and provided with a V-shaped terminal free edge portion engaging with a snap fit the groove of the confronting face of the lower log, said flange being spaced from said lower log, so as to be free to change it angle relative to said main portion upon variations in the spacing between said two logs, said first and second longitudinal free edge portions being biased in respective engagement with the grooves of said upper and lower logs and said bent back portion being biased in engagement with the outer face of said lower log.

* * * * *